United States Patent [19]

Beasley et al.

[11] 4,404,814

[45] Sep. 20, 1983

[54] AUXILIARY CONDENSER COOLING TOOL FOR REFRIGERATED AIR CONDITIONERS

[76] Inventors: Albert W. Beasley, 2127 W. Sheridan; Albert C. Beasley, 2624 NW. 1st, both of Oklahoma City, Okla. 73107

[21] Appl. No.: 316,695

[22] Filed: Oct. 30, 1981

[51] Int. Cl.[3] ..... F28D 3/00

[52] U.S. Cl. ..... 62/171; 62/183; 62/305

[58] Field of Search ..... 62/171, 184, 183, 185, 62/304, 305, 140

[56] References Cited

U.S. PATENT DOCUMENTS 2,213,347 9/1940 Neeson ..... 62/140

2,644,321 7/1953 Borgerd ..... 62/171

3,390,538 7/1968 Miller ..... 62/184

FOREIGN PATENT DOCUMENTS 108557 11/1938 Australia ..... 62/305

*Primary Examiner*—Albert J. Makay

*Assistant Examiner*—Henry Bennett

*Attorney, Agent, or Firm*—Robert K. Rhea

[57] ABSTRACT

An auxiliary condensing coil is interposed between the compressor and primary coil of a refrigerated air conditioner through a pressure sensor operative in response to excessive head pressure for energizing an auxiliary coil fan motor and sump pump. The auxiliary coil is cooled by ambient air and moisture.

3 Claims, 2 Drawing Figures

AUXILIARY CONDENSER COOLING TOOL FOR REFRIGERATED AIR CONDITIONERS

BACKGROUND OF THE INVENTION

1. Field of the Invention

The present invention relates to closed refrigerated air conditioning units and more particularly to an auxiliary condenser coil cooling unit therefor.

As is well known in the art, the motor-compressor of a sealed refrigerating system becomes hot due to insufficient cooling provision especially during relatively high ambient air temperature and/or high humidity thereby resulting in what is known as an overload condition. The refrigerant gas, after expanding in its air cooling function, is conveyed to the condenser coil usually located exteriorly of a space being cooled. The condenser coil is intended to reduce the temperature of the gas and the gas to liquefy, however, as mentioned hereinabove, when the temperature approaches or exceeds 100° F., ambient air drawn across the condenser coils provides insufficient heat exchange relationship for condensing the refrigerant gas.

In this invention an auxiliary condenser coil, containing refrigerant gas, is interposed between the compressor and the primary condenser coil of a sealed refrigerating system through a pressure responsive device to increase the heat exchange capacity of the auxiliary condenser coil in response to a predetermined head pressure and reduce the volume of the refrigerant gas by lowering its temperature which results in less power required for operating the motor-compressor unit since the compressor load decreases.

2. Description of the Prior Art

The most pertinent prior partent is believed to be U.S. Pat. No. 2,213,347 which discloses a housing encased floor mounted refrigerated unit having its condenser coil constantly supplied with a stream of water in the path of air blown through the condenser coil with the water supplied by a sump pump contained by the unit.

This invention is distinctive over this patent by providing an auxiliary condenser coil automatically increasing its refrigerant gas cooling capacity when desired to supplement the cooling action of the primary condenser coil.

SUMMARY OF THE INVENTION

A helically wound vertically disposed auxiliary condenser coil is interposed in a conventional refrigeration unit upstream from the primary condenser coil with a pressure sensor interposed in the input end portion of the auxiliary condenser coil. An open end cylindrical jacket loosely surrounds the auxiliary coil. A sump is disposed at the depending end of the jacket for collecting moisture dripping off the coil. The jacket centrally supports a fan motor in its upper end portion. The motor is provided with an elongated drive shaft having fan blades secured to its upper end adjacent the upper limit of the jacket so that the fan draws air into the jacket from its upper end and exhausts it at the lower end of the jacket within a sleeve surrounding the depending end portion of the jacket. The depending end portion of the jacket is provided with an upward and outwardly inclined flange for the purpose of directing exhausted air laterally of the jacket. The motor drive shaft supports and rotates an upwardly open shallow dish-like member receiving condensation from the refrigerated air conditioner primary condenser coil by a drain tube emptying into the dish for depositing such moisture as a spray on the auxiliary coil and the jacket by angular rotation of the dish. A cup-like tray is coaxially disposed below the dish. Excess water overflowing the dish drains into the tray. Water in the tray drains into an endless drip tube having apertures therein which drips the sump water on an annular evaporative pad surrounding a major portion of the jacket. The sump contains a pump operated simultaneously with the fan motor which pumps water to the dish. An auxiliary water supply is provided to insure a quantity of water within the sump. In response to excessive head pressure, the pressure sensor energizes the auxiliary coil fan and pump motors for spraying water on the auxiliary coil and inducing a flow of air across the auxiliary coil to increase its heat transfer action.

The principal object of this invention is to provide an auxiliary condenser coil cooling unit interposed upstream of the primary condenser coil of a refrigerated air conditioner for supplementing the primary condensing coil cooling action of the air conditioner when the head pressure of refrigerant gas reaches a predetermined limit.

DESCRIPTION OF THE PREFERRED EMBODIMENT

Figure 1:
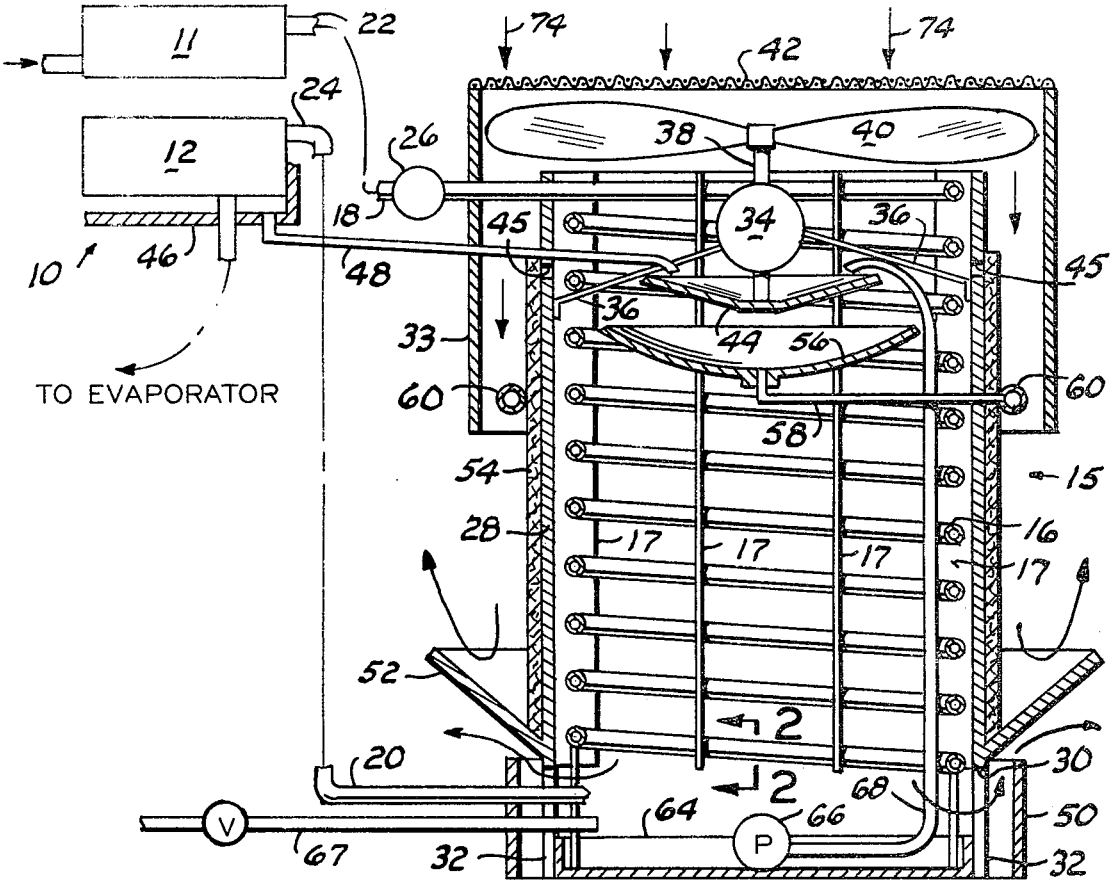
FIG. 1 is a vertical cross sectional view of the auxiliary condensing coil unit, partially in elevation, diagrammatically illustrating its connection with a refrigeration unit; and, FIG. 2 is a fragmentary vertical cross sectional view, to a larger scale, taken along the line 2—2 of FIG. 1, illustrating a preferred cross sectional configuration for the auxiliary condenser coil.

Like characters of reference designate like parts in those figures of the drawings in which they occur.

In the drawings:

The reference numeral 10 indicates a refrigerated air conditioner having a compressor 11 and a primary condenser coil 12. The numeral 15 indicates the auxiliary condenser coil unit, as a whole, which is upright cylindrical in general configuration. The reference numeral 16 indicates an elongated helically wound upright auxiliary condensing coil, supported by a plurality of fins 17, only four being shown for clarity. The auxiliary coil 16 is interposed at its respective end portions 18 and 20 between the outlet 22 of the compressor and the inlet 24 of the primary condensing coil 12. A pressure sensing means 26, connected with a source of electrical energy, not shown, is interposed in the auxiliary coil end portion 18. An open end cylindrical jacket 28 loosely surrounds and projects beyond the respective upper and lower limits of the helically wound portion of the auxiliary coil 16. The depending end portion of the jacket 28 is vertically slotted or cut away, as at 30, to form jacket support legs 32 and openings for exhaust air passage, as presently explained. A top sleeve 33 loosely surrounds and is supported by the upper end portion of the jacket and projects thereabove a selected distance, for the purpose presently apparent.

The upper end portion of the jacket 28 centrally supports a fan motor 34 by braces 36, or the like. The fan motor 34 is provided with an elongated shaft 38 projecting upwardly above the upper limit of the coil 16 and is connected with fan blades 40. The diameter of the fan blades 40 is greater than the diameter of the jacket 28 and slightly smaller than the inside diameter of the sleeve 33 for the reasons presently explained. A screen, or the like, 42, connected with the upper limit of the sleeve 33, excludes leaves, scrap paper, or the like, from entering the jacket. The drive shaft 38 projects downwardly from the motor and supports an upwardly open dish-like receptacle 44 angularly rotated with the drive shaft. The jacket 28 is provided with a horizontal row of apertures 45 in the plane of the upper limit of the receptacle or dish 44. The dish 44 receives condensation moisture draining off the evaporator, not shown, and collected in the housing 46 of the refrigeration unit 10 through a tube 48. The purpose of the dish 44 is to disperse water contained thereby in a spray-like action on the inner wall surface of the jacket, at the position of the apparatus 45, when angularly rotated by the drive shaft 38.

A bottom sleeve 50, substantially coextensive with the height of the exhaust openings 30, loosely surrounds the depending end portion of the jacket 28. The jacket 28 is provided with an annular surrounding upwardly diverging flange 52 disposed adjacent the upper limit of the bottom sleeve 50 and diametrically substantially greater than the diameter of the bottom sleeve. The purpose of the sleeve 50 and flange 52 is to form an air path to divert the air drawn into and through the jacket laterally and upwardly from the depending end of the jacket.

An insulating layer of fibrous or porous material 54 surrounds the exterior of the jacket 28 and extends downwardly from its upper end portion terminating adjacent the flange 52. The flange 52 collects moisture draining off the upper end portion of the layer 54. A shallow stationary cup-like tray 56 is coaxially supported within the coil 16 below the dish 44. The diameter of the tray 56 is substantially greater than the diameter of the dish 44 so that any water falling from the dish, when the motor 34 is idle, will be collected by the tray 56. Water in the tray 56 drains through a tube 58 to an endless tube 60 surrounding the insulating layer 54. The endless tube 60 is provided with a plurality of apertures in its wall so that water therein drains on the insulating layer 54.

A shallow tank or sump 64 is disposed within the depending end portion of the jacket for receiving moisture falling by gravity off the coil 16. A valve equipped line 67, connected with a water supply, not shown, insures a supply of water in the sump 64. A small pump 66, disposed within the sump 64, discharges water, not shown, into the dish 44 by a pipe 68. The fan motor 34 and pump 66 are connected with the source of electrical energy and responsive to the pressure sensor 26 for energizing the fan and the pump simultaneously, as presently explained.

Figure 2:
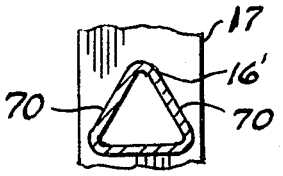

The auxiliary condenser coil 16 is shown as circular in transverse section, however, a preferred cross sectional configuration for the coil is illustrated at 16' (FIG. 2). The transverse action of the coil 16' is substantially triangular so that opposing upwardly converging side walls 70 of the coil 16' provide a greater surface area for dissipating heat of a refrigerant gas to the atmosphere and/or moisture, not shown, falling on the coil.

Operation

In operation, the device 15 is installed as described hereinabove and refrigerant gas is normally circulated through the auxiliary and primary coils. When ambient temperature reaches a certain degree, for example 95° F. or more, and the compressor head pressure exceeds a predetermined value, the pressure sensor 26 simultaneously energizes the fan motor 34 and pump 66. Water contained by the dish 44 is radially discharged by angular rotation of the dish in a vaporizing action which reduces its temperature. Some of this water passes through the jacket apertures 45 and drains on the insulation layer 54 while the remainder falls by gravity on the coil 16 and into the tray 56 to drain through the perforated endless pipe 60 on the insulating layer 54. Air is drawn by the fan in the direction of the arrows 74 into and through the jacket 28.

The purpose of the top sleeve 33 and the fan blades 40 projecting beyind the diameter of the jacket 28 is to insure generation of an air flow downwardly around the periphery of the jacket and insulating layer 54 wherein warm ambient air enhances the vaporization of the moisture in and on the insulating layer 54 and increases the heat transfer from the refrigerant gas within the coil 16 to the air. Air forced downwardly over the coil 16 is exhausted from the jacket through the openings 30. The flange 52 further functions to deflect the stream of air flowing downwardly around the jacket, from within the sleeve 33, in an upward direction for reducing the ambient air temperature in the vicinity of the fan intake. This action continues until the reduction of the head pressure in the refrigeration unit 10 permits the sensor 26 to interrupt operation of the auxiliary coil fan and pump.

Obviously the invention is susceptible to changes or alterations without defeating its practicability. Therefore, we do not wish to be confined to the preferred embodiment shown in the drawings and described herein.

We claim:

1. In an air conditioner unit of the self contained type having a primary condenser coil and a housing collecting condensed moisture, the improvement comprising:

an upright open end jacket;

a liquid containing sump within the depending end portion of said jacket;

a layer of moisture absorbent material surrounding said jacket intermediate its ends;

an endless tube surrounding said absorbent material adjacent its upper end, said endless tube having a plurality of downwardly open apertures;

an auxiliary condenser coil carrying fluid to be condensed by cooling disposed adjacent the inner periphery of said jacket and communicating with said primary coil;

auxiliary fan and motor means including a motor drive shaft coaxially supported by the upper end portion of said jacket for generating a flow of ambient air across said auxiliary coil and through said jacket;

a dish coaxially supported by and angularly rotated with said drive shaft;

a tray coaxially supported below said dish;

pump and pipe means moving liquid contained by said sump to said dish;

first drain tube means connecting said housing with said dish;

second drain tube means connecting said tray with said endless tube; and, fluid pressure sensing means connected with a source of electrical energy and interposed in the inlet end portion of said auxiliary coil for energizing said auxiliary fan and motor means in response to predetermined fluid pressure.

2. The combination according to claim 1 in which the wall of said jacket is provided with a horizontal row of apertures in the plane of the upper limit of said dish and in which said fan and motor means includes a fan having a diameter greater than the diameter of said jacket and further including:

a sleeve loosely surrounding said fan and the upper end portion of said jacket for confining a portion of the fan induced flow of ambient air adjacent the outer periphery of said moisture absorbent material.

3. The combination according to claim 2 further including:

an annular upward and outwardly directed flange secured to the depending end portion of said jacket for changing the direction of fan induced air flow.

* * * * *